United States Patent [19]

Kroó et al.

[11] 4,425,219

[45] Jan. 10, 1984

[54] METHOD FOR THE PRODUCTION OF LIQUID CARBON COMPOUNDS FROM COAL

[75] Inventors: Erik Kroó; László Kovács; István Nemes, all of Budapest; Katalin Szabó née Mogyorósi; Géza Szentgyörgyi, both of Tatabánya; Galina Móger née Eremineva, Budapest; András Németh, Budapest; Dezsö Gál, Budapest; Szilárd Riederauer, Budapest; János Szépvölgyi, Tatabánya, all of Hungary

[73] Assignee: Tatabányai Szénbányák, Tatabanya, Hungary

[21] Appl. No.: 288,765

[22] Filed: Jul. 31, 1981

[51] Int. Cl.[3] ..... C10G 1/04; C10B 57/06

[52] U.S. Cl. ..... 208/8 R; 208/8 LE

[58] Field of Search ..... 208/8 R, 8 LE

[56] References Cited

U.S. PATENT DOCUMENTS

| | | | |
|---|---|---|---|
| 3,808,119 | 4/1974 | Bull et al. | 208/8 LE |
| 3,841,991 | 10/1974 | Cohen et al. | 208/8 R |
| 3,997,424 | 12/1976 | Urquhart | 208/8 R |
| 4,030,893 | 6/1977 | Keller | 208/8 LE |
| 4,089,773 | 5/1978 | Espenscheid | 208/8 LE |
| 4,180,452 | 12/1979 | Sinor | 208/8 LE |
| 4,250,014 | 2/1981 | Long et al. | 208/8 R X |
| 4,252,633 | 2/1981 | Long et al. | 208/8 LE |
| 4,298,450 | 11/1981 | Ross et al. | 208/8 LE |

*Primary Examiner*—Delbert E. Gantz
*Assistant Examiner*—Glenn A. Caldarola
*Attorney, Agent, or Firm*—Karl F. Ross; Herbert Dubno

[57] ABSTRACT

The invention relates to an improved method for the production of liquid carbon compounds from coal. According to the invention coal is oxidized at 80° to 300° C. in the presence of the vapors of a $C_{1-5}$ aliphatic alcohol, optionally under the introduction of steam, and then the liquid carbon compounds are separated from the resulting product mixture.

The process according to the invention can also be performed under atmospheric pressure, 50–80% of the carbon content of the coal converted appear in the liquid product. The liquid product contains the more valuable fraction, boiling below 300° C., as major component.

11 Claims, No Drawings

METHOD FOR THE PRODUCTION OF LIQUID CARBON COMPOUNDS FROM COAL

The invention relates to an improved method for the production of liquid hydrocarbon compounds from coal.

The known methods for liquefaction of coal can be divided into three groups. One of these groups is the wellknown Fischer-Tropsch synthesis and modified versions thereof, according to which coal is first converted into synthesis gas containing carbon monoxide and hydrogen, and then liquid products are produced from the synthesis gas by contact catalytic methods. According to the known methods of the second group, coal is subjected to hydrogenation to obtain liquid products [see e.g. Chem. Ing. Techn. 46, 925 (1974)]. In the method belonging to the third group coal is treated with organic solvents (preferably solvents with large hydrogen content) in order to extract the liquid products therefrom. This extraction method is also applied in combination with the hydrogenation of coal (see e.g. NIMDOK Vegyipari Szakirodalmi Tajekoztato, Budapest, 1975, No. 1).

The known methods have several disadvantages from the aspects of the industrial realization. Fischer-Tropsch synthesis and the methods based on the hydrogenation of coal are very expensive, require specific installations, great capital investment and much energy. Their thermal efficiency is also insufficient. It is a further disadvantage that the reactions proceed only at pressures significantly higher than atmospheric, thus the reactions can be performed only in apparatuses of specific construction and under strict security measures. The methods based on the extraction of coal run with very low yields, the specific energy consumption (related to unit weight of liquid products) is extremely high, and the recovery of the extraction medium further increased the costs of operation.

The method of the invention enables one to produce liquid carbon compounds from coal by a much simpler technique than the known ones.

It has been observed that if coal is oxidized in the presence of vapors of $C_{1-5}$ aliphatic alcohols, the partial liquefaction of coal can be performed even under atmospheric pressure and at temperatures much lower than these applied so far. Under such conditions about 5 to 20% of liquid carbon compounds are formed, related to dry coal, within a reaction time of one hour, which means that about 50–80% of the carbon content of the coal converted appear in the liquid carbon compounds.

Based on the above, the invention relates to an improved method for the production of liquid hydrocarbon compounds from coal. According to the invention one proceeds so that coal is oxidized at 80°–300° C. in the presence of the vapors of a $C_{1-5}$ aliphatic alcohol, optionally under the introduction of steam, and the liquid carbon compounds are separated from the resulting mixture.

It is preferred to apply methanol as aliphatic alcohol, however, straight-chained or branched aliphatic alcohols with longer carbon chains, such as ethanol, n-propanol, isopropanol, n-, sec.-, iso- or tert.-butanol, etc., can also be used either alone or in combination with each other. These alcohols form hydrocarbyl radicals or oxygen-containing hydrocarbyl radicals under the conditions of the reaction, which promote the formation of liquid carbon compounds.

The reaction can be performed optionally while introducing steam into the system. When wet coal, as mined (containing usually about 20% of water), is applied as starting substance, it is not necessary to introduce steam into the system at the initial stage of the reaction, until the humidity content of coal does not drop below a pre-determined value, generally about 5%. If, however, dry or anhydrous coal is applied as the starting substance, it is preferred to introduce steam into the system. Steam and alcohol vapors are applied preferably in a volume ratio of 4:1 to 1:4.

Alcohol vapors and steam can be introduced either separately or in admixture with each other.

Oxygen gas or air enriched in oxygen can also be applied as oxidizing agent in the reaction; in order to suppress the formation of liquid products with higher degree of oxidation (e.g. ketones, carboxylic acids, etc.); it is preferred, however, to utilize air or air with reduced oxygen content (e.g. a mixture of air and an inert gas, such as nitrogen). According to a particularly preferred method of the invention mixtures of air with carbon dioxide and/or carbon monoxide are applied as oxidation agent. In such instances, on the one hand, the carbon-containing gas introduced suppresses the formation of less valuable carbon-containing gases (carbon dioxide and carbon monoxide), and, on the other hand, it also participates in the oxidation process and its carbon content is built into the resulting liquid carbon compounds. One can also proceed so that the gas mixture leaving the reactor (which always contains carbon dioxide and/or carbon monoxide) is recirculated into the process, optionally after desulfurization.

A particular advantage of the process according to the invention is that it can also be performed under atmospheric pressure. If desired, however, the pressure can be raised above atmospheric in order to increase the capacity of the reactor.

The composition of the liquid product mixture obtained according to the invention is very favorable. The major part of the liquid carbon compounds (generally at least 80–90%) consists of the fraction boiling below 300° C., which contains the complete homologous series of aliphatic hydrocarbons with 13–23 carbon atoms. This product fraction also contains oxygen-containing carbon compounds with low boiling point, primarily ketones, aldehydes and carboxylic acids, in an amount of about 10–15% by weight. The share of the less important fraction (viscous fraction or tar fraction) boiling above 300° C. is relatively low in the product mixture. As an additional advantage, much less carbon-containing gases with lower industrial value (carbon dioxide and carbon monoxide) are formed in the process of the invention than in the case of conventional methods.

It is another very important advantage of the method of the invention that the quality of residual solid coal improves: the sulfur content of the coal decreases by about 30–50% and the share of oxygen-containing compounds increases, which latter involves the increase of combustibility. Thus residual solid coal can be applied to advantage as fuel and may have further uses in the chemical industry (e.g. it can be applied to advantage as starting substance in the liquid-phase oxidation processes).

It is to be noted that in the process of the invention the alcohol introduced can also react with the inorganic materials (e.g. sulfur compounds) present in the coal. If these reactions are to be suppressed, one proceeds preferably so that alcohol is introduced into the system only in the stage of tar formation, and the reaction is conducted further without introducing alcohol.

The process of the invention is illustrated in detail by the aid of the following non-limiting Example.

EXAMPLE

Coal with a humidity content of 22% by weight and having the elementary composition as defined below is applied as starting substance:

| | |
|---|---|
| C | 52.4% by weight |
| H | 5.51% by weight |
| S | 6.95% by weight |
| Incombustible components | 33.7% by weight |

The starting substance is treated with a 1:1 v/v mixture of steam and air (Test 1, comparative test) or with a 3:1:4 v/v/v mixture of steam, methanol vapour and air (Test 2, method of the invention) for 50 minutes at 240° C. under atmospheric pressure. The results of the tests are summarized in the following Table.

TABLE

| | Test 1 | Test 2 |
|---|---|---|
| Apparent weight loss of coal, % by weight | 33.0 | 33.0 |
| Oxygen uptake of coal, % by weight | 17.1 | 21.8 |
| Real weight loss of coal, related to the starting coal, % by weight | 50.1 | 54.8 |
| Distribution of the real weight loss of coal in the products: | | |
| Water, % by weight | 20.0 | 20.0 |
| Total amount of sulfur, % by weight | 1.6 | 2.4 |
| Sulfur in the gas phase | 1.4 | 2.2 |
| Sulfur in the liquid phase | 0.2 | 0.2 |
| Inorganic ash components, % by weight | 15.7 | 20.6 |
| Total amount of liquid products, % by weight | 2.4 | 6.3 |
| Fraction "A"* | 1.4 | 6.2 |
| Fraction "B"** | 1.0 | 0.1 |
| Gases, % by weight*** | 9.1 | 5.5 |

Remarks:
*Fraction boiling below 300° C.
**Fraction boiling above 300° C.
***The gases contain $C_{1-4}$ hydrocarbons, carbon monoxide, carbon dioxide, sulfur dioxide, carbon oxysulfide and mercaptans If one proceeds as described above, however, without introducing steam into the system, the share of the liquid products in the real weight loss of carbon, amounting to about 50% by weight, is 5.07% by weight. The distribution of fractions "A" and "B" in the liquid products is as follows:

fraction "A": 4.52% by weight fraction "B": 0.55% by weight

The following conclusions can be drawn from the above date:

(1) The residual solid coal takes up more oxygen in the method of the invention than in the comparative test, i.e. its combustion properties are superior.

(2) At least twofold amount of liquid carbon compounds is formed in the method of the invention than in the comparative test. 88 to 98% by weight of the liquid products formed in the method of the invention consist of the more valuable fraction with a boiling point lower than 300° C., whereas the share of the same fraction is 58% by weight of the comparative test.

(3) About 70–80% of the carbon content of the coal converted appear in the liquid products when one proceeds according to the invention, whereas this ratio is only about 30% in the comparative test.

(4) The amount of gases formed in the process of the invention is much lower than that observed in the comparative test. Taking into account that about 40–50% of the gas mixture obtained in the process of the invention consist of sulfur-containing compounds, it can be concluded that about 20–30% of the carbon content of the coal converted appear in the less valuable gases. This ratio is about 70% in the comparative test.

(5) By the method of the invention more sulfur and inorganic ash components can be removed from the coal than in the comparative test.

These facts clearly demonstrate the significant technical advantages arising from the method of the invention.

What we claim is:

1. A method for the production of liquid hydrocarbons from coal wherein 88 to 98% of said liquid hydrocarbons have a boiling point lower than 300° C. which comprises the steps of:

(a) oxidizing coal at a temperature of 80° to 300° C. in a solvent consisting of a $C_1$ to $C_5$, alcohol in vapor form to yield a product mixture containing said liquid hydrocarbons; and (b) separating the liquid hydrocarbons from the product mixture.

2. The method defined in claim 1, step (a), wherein steam is introduced into the oxidation process.

3. The method defined in claim 1, step (a), wherein methanol is used as the $C_1$ to $C_5$ alcohol.

4. The method defined in claim 2, wherein the steam is introduced continuously into the system from the start of oxidation in a volume ratio of 4:1 to 1:4 relative to the volume of the alcohol in vapor form.

5. The method defined in claim 2 wherein steam is introduced only where the humidity content of the coal remaining in the solid phase drops below 5%.

6. The method defined in claim 1, step (a), wherein the oxidation is performed at atmospheric pressure.

7. The method defined in claim 1, step (a), wherein the oxidation is carried out with an oxidizing agent selected from the group consisting of air and air having a reduced oxygen content.

8. The method defined in claim 7 wherein the air with a reduced oxygen content is air enriched with carbon dioxide, air enriched with carbon monoxide, or air enriched with carbon dioxide and carbon monoxide.

9. The method defined in claim 7 wherein following step (a), the used oxidizing agent is applied again as oxidizing agent for a new supply of coal.

10. The process defined in claim 9 wherein the used oxidizing agent is combined with fresh air prior to use as oxidizing agent for a new supply of coal.

11. The process defined in claim 9 wherein the used oxidizing agent is desulfurized prior to use as oxidizing agent for a new supply of coal.

* * * * *